US009314986B2

(12) United States Patent
Morgana et al.

(10) Patent No.: US 9,314,986 B2
(45) Date of Patent: Apr. 19, 2016

(54) METHOD AND SYSTEM FOR APPLYING AN ADAPTIVE PERFORATION CUT TO A SUBSTRATE

(71) Applicant: Xerox Corporation, Norwalk, CT (US)

(72) Inventors: Stephen C. Morgana, Rochester, NY (US); Reiner Eschbach, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 677 days.

(21) Appl. No.: 13/664,759

(22) Filed: Oct. 31, 2012

(65) Prior Publication Data

US 2014/0121800 A1 May 1, 2014

(51) Int. Cl.
*B31B 1/00* (2006.01)
*B26D 5/34* (2006.01)

(52) U.S. Cl.
CPC ... *B31B 1/00* (2013.01); *B26D 5/34* (2013.01); *B31B 2201/14* (2013.01); *B31B 2201/95* (2013.01); *B31B 2203/082* (2013.01)

(58) Field of Classification Search
CPC ..... B26D 5/34; B31B 1/00; B31B 2201/14; B31B 2201/95; B31B 2203/082
USPC ..... 700/98
See application file for complete search history.

(56) References Cited

U.S. PATENT DOCUMENTS 5,353,390 A 10/1994 Harrington
5,528,517 A 6/1996 Loken
5,805,784 A 9/1998 Crawford
5,838,574 A 11/1998 Olson et al.
5,881,538 A 3/1999 Blohm
6,005,959 A 12/1999 Mohan et al.
6,117,061 A 9/2000 Popat et al.
6,134,018 A 10/2000 Dziesietnik et al.
6,153,039 A 11/2000 Jacobsen
6,243,172 B1 6/2001 Gauthier et al.
6,246,468 B1 6/2001 Dimsdale
6,332,149 B1 12/2001 Warmus et al.
6,687,016 B2 2/2004 Gauthier (Continued)

FOREIGN PATENT DOCUMENTS

EP 621113 A1 10/1994
WO WO-2005122079 A2 12/2005

(Continued)

OTHER PUBLICATIONS

Lu et al., "Folding Cartons with Fixtures: A Motion Planning Approach", IEEE Transactions on Robotics and Automation, vol. 16, No. 4, Aug. 2000, pp. 346-356.

(Continued)

*Primary Examiner* — Carlos Ortiz Rodriguez
*Assistant Examiner* — John Park
(74) *Attorney, Agent, or Firm* — Fox Rothschild LLP

(57) ABSTRACT

A method and system automatically and dynamically updates the design of perforation lines in a package design file. It identifies an edge between two facets to which a perforation line is to be applied, determines a length of the edge, and uses the length of the edge and a default cut segment length to determine a number of cut segments that will be included in the perforation line. The method and system also may determine a phasing for the perforation line to ensure that the ends of the line are either a cut or spacer, depending on the desired function or placement of the line.

18 Claims, 5 Drawing Sheets

(56) References Cited

U.S. PATENT DOCUMENTS

| | | | |
|---|---|---|---|
| 6,689,035 | B1 | 2/2004 | Gerber |
| 6,771,387 | B2 | 8/2004 | Gauthier |
| 6,895,549 | B1 | 5/2005 | Albright et al. |
| 6,939,063 | B2 | 9/2005 | Bussell |
| 6,945,645 | B2 | 9/2005 | Baron |
| 6,953,513 | B1 | 10/2005 | Volkert |
| 7,013,616 | B1 | 3/2006 | Powers et al. |
| 7,174,720 | B2 | 2/2007 | Kennedy |
| 7,293,652 | B2 | 11/2007 | Learn et al. |
| 7,327,362 | B2 | 2/2008 | Grau |
| 7,366,643 | B2 | 4/2008 | Verdura et al. |
| 7,647,752 | B2 | 1/2010 | Magnell |
| 7,832,560 | B2 | 11/2010 | Tilton |
| 7,941,465 | B2 | 5/2011 | Gombert et al. |
| 8,160,992 | B2 | 4/2012 | Gombert et al. |
| 8,170,706 | B2 | 5/2012 | Gombert et al. |
| 8,170,709 | B2 | 5/2012 | Puissant |
| 2002/0091592 | A1 | 7/2002 | Sugiura et al. |
| 2002/0104293 | A1 | 8/2002 | Armington et al. |
| 2002/0118874 | A1 | 8/2002 | Chung et al. |
| 2003/0035138 | A1 | 2/2003 | Schilling |
| 2003/0083763 | A1 | 5/2003 | Kiyohara et al. |
| 2003/0091227 | A1 | 5/2003 | Chang et al. |
| 2003/0164875 | A1 | 9/2003 | Myers |
| 2005/0050052 | A1 | 3/2005 | Zimmerman et al. |
| 2005/0249400 | A1 | 11/2005 | Fukumoto |
| 2007/0041035 | A1 | 2/2007 | Sembower et al. |
| 2007/0042885 | A1 | 2/2007 | Rietjens et al. |
| 2007/0112460 | A1 | 5/2007 | Kiselik |
| 2008/0020916 | A1 | 1/2008 | Magnell |
| 2008/0255945 | A1 | 10/2008 | Percival et al. |
| 2009/0278843 | A1 | 11/2009 | Evans |
| 2009/0282782 | A1 | 11/2009 | Walker et al. |
| 2009/0287632 | A1 | 11/2009 | Gombert et al. |
| 2010/0058943 | A1 | 3/2010 | Bober |
| 2010/0060909 | A1 | 3/2010 | Conescu et al. |
| 2010/0098319 | A1 | 4/2010 | Gombert et al. |
| 2010/0110479 | A1 | 5/2010 | Gombert et al. |
| 2010/0214622 | A1 | 8/2010 | Ruegg et al. |
| 2011/0052888 | A1 | 3/2011 | Eschbach et al. |
| 2011/0116133 | A1 | 5/2011 | Walker et al. |
| 2011/0149337 | A1 | 6/2011 | Goetz et al. |
| 2013/0120767 | A1 | 5/2013 | Mandel et al. |
| 2013/0120770 | A1 | 5/2013 | Mandel et al. |
| 2014/0038801 | A1 | 2/2014 | Morgana et al. |
| 2014/0038802 | A1 | 2/2014 | Clark et al. |
| 2014/0040319 | A1 | 2/2014 | Morgana et al. |
| 2014/0067104 | A1* | 3/2014 | Osterhout ..... G06Q 50/28 700/97 |

FOREIGN PATENT DOCUMENTS

| | | | |
|---|---|---|---|
| WO | WO-2006108269 | A1 | 10/2006 |
| WO | WO-2007021920 | A2 | 2/2007 |

OTHER PUBLICATIONS http/www.esko.com/tmp/080606115325/G2558322__Kongsberg__tables__us__pdf.

* cited by examiner

METHOD AND SYSTEM FOR APPLYING AN ADAPTIVE PERFORATION CUT TO A SUBSTRATE

BACKGROUND

When selecting a package for a product that is to be sold or shipped, product manufacturers and sellers typically must select a package from a specific inventory of available package sizes and shapes. However, this may result in a package that is not entirely suitable for the product. For example, when using a package that is larger than the product requires, additional packaging material may be needed to avoid damage to the product during handling. In addition, a larger package can require increased shipping and handling costs. Thus, there has been significant interest in the manufacture of personalized packaging for small volume applications.

When creating a three-dimensional package, a set of cut lines and crease lines will be imparted upon a substrate to yield a package flat that may be folded into a three-dimensional package. In the personalized packaging situation, the dimensions and/or positions of such lines will need to vary from package to package. However, current systems do not have the capability to produce packages with sufficient variability to avoid issues with improperly sized and/or positioned cut and fold lines.

This document describes systems and methods that present solutions to the problems discussed above, and which may also provide additional benefits.

SUMMARY

In an embodiment, a system accesses a package design file comprising a two-dimensional representation of a three-dimensional structure. The three-dimensional structure has multiple facets. The system identifies an edge between two facets to which a perforation line is to be applied. The perforation line includes cut segments and spacers. The system determines a length of the edge, and it uses the length of the edge and a default cut segment length to determine a number of cut segments that will be included in the perforation line. If the number is not an integer, the system determines an integer number of cut segments by rounding the number up or down, setting the number of cut segments to equal the integer number, and determining a revised cut segment length based on the number of cut segments and the edge length. The system them updates the package design file to include data indicating that the perforation line will include the integer number of cut segments.

In some embodiments, when determining the revised cut segment length comprises, the system will use a processor to determine that the integer number of cut segments at the default cut segment length will result in a perforation line length that exceeds the length of the edge. If so, it may implement a reduction process comprising reducing the cut segment length of at least one of the cut segments, a length of at least one of the spacers, or both.

In some embodiments the reduction process may include determining that a minimum length must be preserved for a spacer that is positioned at an end of the perforation line, and if so the system may limit reduction of the length of the spacer that is positioned at the end to the minimum length, while reducing the length of at least one other spacer in the line to a length that is below the minimum length.

In some embodiments, the reduction process may include determining that a minimum length must be preserved for a cut segment that is positioned at an end of the perforation line, and if so the system may limit reduction of the length of the cut segment that is positioned at the end to the minimum length, while reducing the length of at least one other cut segment to a length that is below the minimum length.

In some embodiments, determining the number of cut segments to include the perforation line comprises determining whether the edge will be a crease, and if so setting the number of cut segments as an even number. In other embodiments, determining the number of cut segments to include in the perforation line comprises determining whether the edge will be a separation line, and if so setting the number of cut segments as an odd number.

In some embodiments, if the system determines that a first end of the perforation line will be adjacent to another edge in the three-dimensional structure, it may ensure that a phasing of the perforation line is such that the first end will be a spacer and not a cut segment. In additional embodiments, the system may determine a length of the edge, determine an aspect ratio of cut segment length to spacer length based on the length of the edge, and assign lengths to the cut segments and spacers in the perforation line based on the aspect ratio.

Any or all of the items listed above may be implemented by a package definition system that includes a data storage facility, a processor, and a computer-readable medium containing programming instructions that, when executed, instruct the processor to perform various functions. Optionally, the system also may include a user interface and/or a package generation device.

DETAILED DESCRIPTION

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used in this document have the same meanings as commonly understood by one of ordinary skill in the art. As used in this document, the term "comprising" means "including, but not limited to."

As used in this document, the term "multi-functional device" refers to a machine or group of machines comprising hardware and associated software for printing, copying, facsimile transmitting or receiving, scanning, or performing other actions on document-based data. A "print device" is a device that performs printing based on digital data, or a multi-functional device in which one of the functions is printing based on digital data. A "package generation system" is a machine or group of machines that combines the features of a print device with one or more tools for imparting a cut, crease, and/or perforation on a printed substrate so that the substrate may be folded into a three-dimensional package, or other folds or structures.

Package production may be performed by a package generation system that is capable of performing printing operations on, and applying creases and cuts to, a substrate. The system also may perform other actions such as coating and/or stacking the substrate. Examples of automated package production systems include those in the iGen® series of digital production printing presses, available from Xerox Corporation, in connection with corresponding finishing devices. Other systems may include smaller printing devices, such as a Xerox DocuColor® 250, or a digital cutter as offered by a variety of manufacturers.

One aspect in the creation of a package is that the printing device operates on a two dimensional sheet or "flat." The actual three-dimensional shape of the package is subsequently created by folding and connecting the facets that make up the flat. Here it is understood that various types of folds may create a three-dimensional structure or shape in the language of this application. This imposes a variety of restrictions on the structure both in its two dimensional form, as well as in its three dimensional form. The substrate is typically a paper material, such as cardstock, cardboard, or paper having sufficient thickness to provide structural support when folded into a three-dimensional shape.

Figure 1:
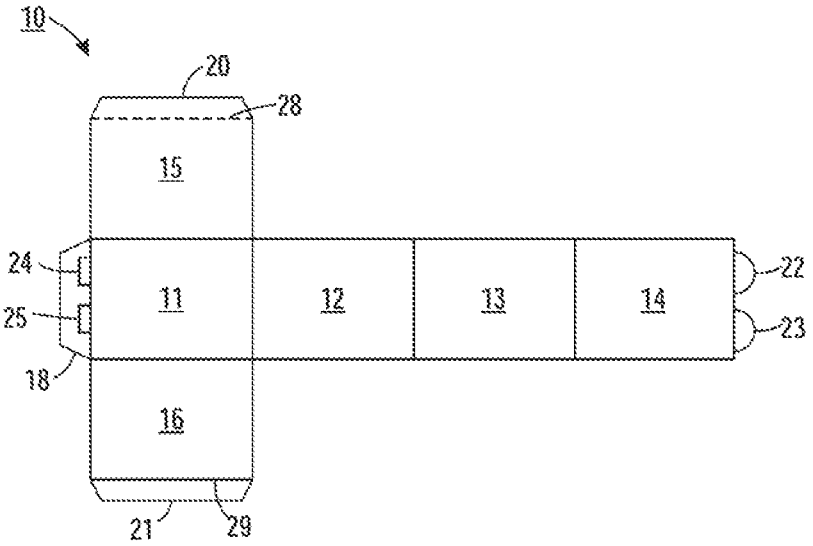
FIG. 1 depicts an example of a two-dimensional package flat.

FIG. 1 shows an example of a package flat 10 that may be formed into a three-dimensional package. This package flat 10, in this case a rectangular box, includes a variety of faces 11-16. Faces 11-14 may be considered sides, while faces 15 and 16 may be considered to be the top and bottom lids of the package. Each of the faces may be considered to be an exterior-facing facet, or a structural element of the final package Facets also may include various functional elements that provide a connecting or other structural function for other elements of the package. Functional elements may include folds, lids, lips, tabs, flaps, receptacles, or other structures that either extend into or are received by a face or a corresponding functional element. Examples shown in FIG. 1 include flaps 18, 20 and 21, along with locking tabs 23, 24 and a corresponding lip 18 with slots 24, 25 that receive the tabs when the package is folded.

The outer edges of the package are cut from a substrate, while various cut lines and/or crease lines may be imparted on the substrate within the outer edges of the package to distinguish the various facets and allow the facets to be folded into a three dimensional shape. Examples include a crease line 29 that will enable flap 21 to be folded toward face 16, a crease line 28 that will serve to form a fold line that will enable flap 20 to be folded toward face 15. These creases might be implemented in a variety of different ways as a function of hardware capability and fold properties. As shown, crease line 29 is formed as a standard crease line or kiss cut (described in more detail below), while crease line 28 is formed as a perforation line, where each perforation line includes perforation cut segments, with spacers of uncut substrate positioned between the perforation cut segments and/or the end of the perforation line.

Figure 2:
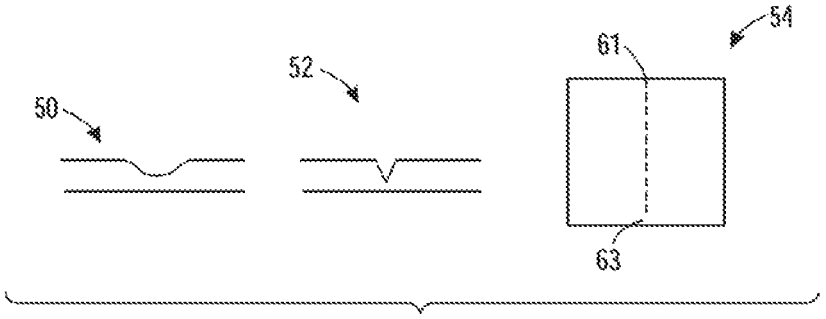
FIG. 2 depicts examples of substrates that contain a crease line, a "kiss cut" line, and a perforation cut line.

FIG. 2 illustrates examples of substrates on which different crease lines are imparted. In the side view of the first substrate 50, a standard crease line has been imparted. When creating a standard crease line, a tool such as a roller or other item containing a dull tip is used to compress the substrate. With a standard crease line, the fibers of the substrate are compressed but largely remain intact. In the side view of the second substrate 52, a cut line has been imparted. However, the cut does not fully extend trough the substrate. Rather, the top surface has been scored to a limited depth. A functional crease that is implemented through this type of cut line may be referred to as a score line, or "kiss cut," and it may serve as a fold line in a substrate. A kiss cut may be imparted with a knife by subjecting the knife to a pressure that is less than that required to fully cut through the substrate. Either or both types of creases (compression vs. kiss cut) may be used, or only one may be used depending on hardware capabilities of the available equipment.

In the top view of substrate 54, another functional crease has been generated through the use of a perforation cut line. The perforation cut line consists of a line of perforation cut segments imparted on the substrate, with a portion of the substrate remaining intact between each cut. Each such intact portion may be referred to as a "spacer." In FIG. 2, the perforation line applied to substrate 54 has different properties at its top and the bottom end. The top end 61 of the perforation line is a cut segment that extends to the edge of the facet, while the bottom end 63 of the perforation line does not include a cut segment that extends to the edge. If such a perforation line were used to serve as a fold line, it would promote tearing away of the two sections of the facet at the top end 61. If such a perforation line were used to serve as a separation line, it would not allow the sections of the facet to be cleanly separated from each other at the bottom end 63. In this document, the characteristic of a perforation line that indicates whether or not its cut segments extend to an edge of the facet (i.e., the end of the cut line) is referred to as "phasing" of the line, and the example of FIG. 2 shows a perforation line with two different types of phasing.

Figure 3:
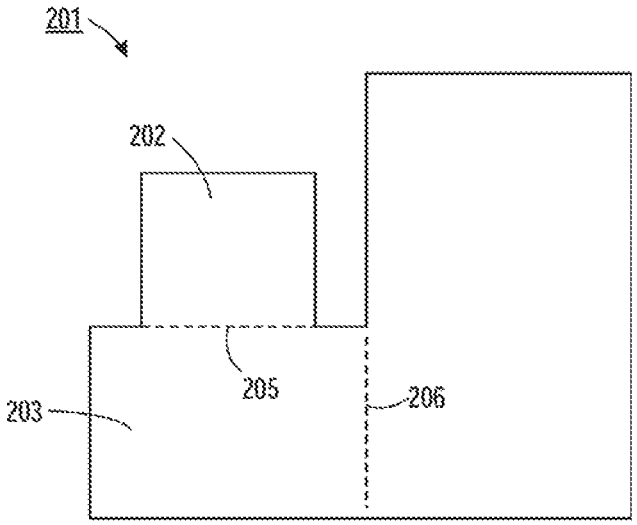
FIG. 3 is an illustration showing different types of phasing that may be used in perforation lines.

In certain designs, when creating a package flat, it is often desirable that a given perforation line have a single type of phasing at both of its ends. The type of phasing used (i.e., cuts at the ends, or spacer at the ends) will depend on whether the perforation line is intended to serve as a fold line or a separation line in the final package. This is conceptually shown in FIG. 3, where a simple example shape 201 includes three facets 202, 203 and 204, with facets 202 and 203 being separated by dynamic perforation line 205 and facets 203 and 204 being separated by dynamic perforation line 206. As can be seen from the phasing of 205 and 206, the facet 202 is easily detachable whereas the perforation line 206 has its edges protected keeping facets 203 and 204 together. It is understood that in a real application where a facet is intended to be detached, one would also alter the aspect ratio of the perforation line, i.e.: the relative size of cut and spacer, to yield a lower physical strength. This has been omitted in FIG. 3 for simplicity.

The problem of different types of phasing in a perforation line may occur quite often in a personalized packaging system. Although a personalized packaging system may start with a template or other data that contains initial design details for a package flat, those details may change as the package size changes. This document describes a system that ensures proper phasing of a perforation line as the design details of a package flat are changed.

Various parameters for construction of a package may be embodied in a package design file, which is a set of data that can be used by a package generation system to create a package flat from a substrate. The package design file may contain rules and/or parameters relating to sizes of facets; connecting relationships of pairs of facets; location, size and type of various cut lines and/or crease lines. The system may use a package generation rule set in the design file, or it may apply parameters from the file to a separate rule set, to construct a package flat from a substrate.

Figure 4:
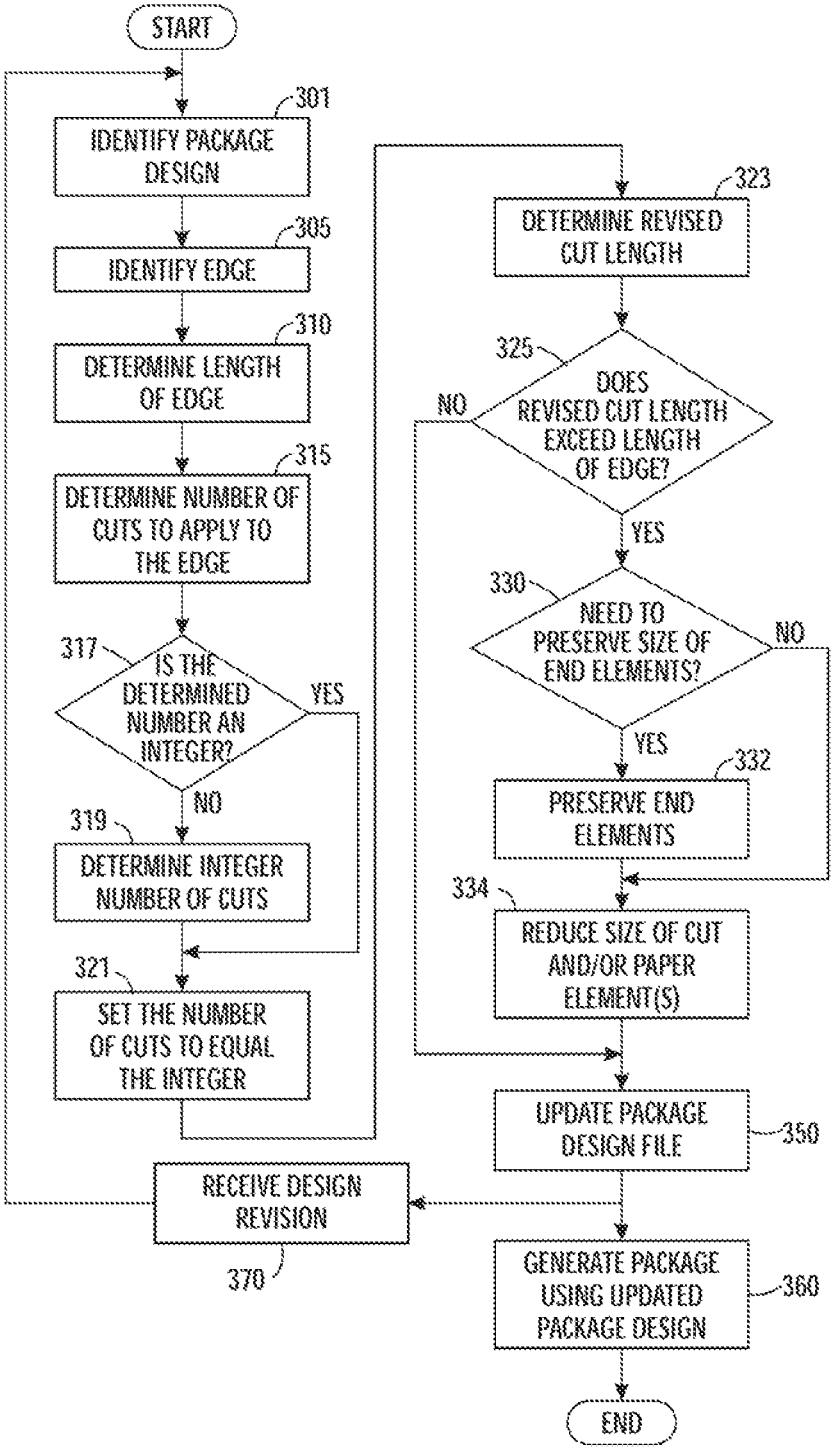
FIG. 4 is a flowchart illustrating various steps in a process for determining how to implement a perforation cut to a substrate.

FIG. 4 is a flowchart describing various elements of a process of dynamically determining characteristics of a perforation line for a package design file as the package's facets are modified in terms of size and/or location. Referring to FIG. 4, a processor accesses a package design file 301, such as by retrieving it from a memory or receiving it via an electronic communication. The package design file contains data corresponding to a two-dimensional representation of a three-dimensional structure that has multiple facets. In other words, the three-dimensional structure is that of a package, and the two-dimensional representation includes data for creating a two-dimensional package flat that may be used to form the three-dimensional package.

The system accesses the data in the file to identify an edge between two facets to which a perforation cut line is to be applied 305. This may be done based on actual data in the file indicating that an edge is to contain such a perforation line. Alternatively, this determination may be done based on the application of one or more package design rules to data in the file or received from a user to determine that a particular edge should contain a perforation line in accordance with the rules.

The system then determines the length of the edge 310, which also may be based on actual data in the file, or it may be calculated by applying one or more package design rules to data in the file or data received from a user. The system may then determine a number of perforation cut segments that will be applied to the edge 315 as a perforation line based on the length of the edge and a default perforation cut segment length, and it may also determine whether the number is an integer 317. This process will be described in more detail below. If the number is an integer, the system may update the package design file with data indicating that integer number of cut segments should be applied to the edge 350. If the number is not an integer, the system may determine an integer number of perforation cut segments by rounding the determined number of cut segments up or down 319, setting the number of perforation cut segments to equal the integer 321, and determining a revised perforation cut segment length based on the set number of cut segments and the edge length 323, Optionally, if the system receives an update 350 from a user or other external source that results in a modification of the package design, the process may re-start. Otherwise, the system may use the package design file to create a two-dimensional package flat or transmit a message to a package generation system for such use 360.

When determining a number of cut segments for a perforation line (step 315 above), the determination may be based on any suitable criteria. For example, for a given paper thickness, the system may have a default or preferred cut segment length (i.e., a lateral dimension for each cut segment) and spacer length (i.e., a lateral dimension for each spacer between cut segments and/or between a cut segment and the end of the cut line). The ratio between the default cut segment length and the default spacer length may be considered to be a perforation aspect ratio—i.e., a ratio of the default cut segment length to the default spacer length. As an example, if the perforation aspect ratio=1, the system may calculate a number of perforation elements N (cut segments plus spacer elements) for a particular perforation line using the following formula:

$$N = \left\lfloor \frac{L}{l_c + l_p} \right\rfloor \times 2 + 1$$

In this formula:

L=length of the edge;

$l_C$=the default or preferred cut segment length, based on data in the package design file and/or the application of one or more rules to user input data; and $l_P$=the default or preferred spacer length, based on data in the package design file and/or the application of one or more rules to user input data;

If the edge is to be a fold, the number of cut segments $N_C$=N/2 (an even number) and the number of spacer elements $N_P$=N/2+1 (an odd number) based on the aforementioned phasing requirements. If the edge is to be a separation line then these calculations are reversed and the number of cut segments $N_C$=N/2+1 (an odd number) while the number of spacer elements $N_P$=N/2 (an even number).

By way of example, if an edge length L is 50 mm, the default cut segment length $l_C$ is 5 mm, the default spacer length $l_P$ is also 5 mm, and the line is to be a crease, then using the formula above N=11, the number of cut segments $N_C$=6 and the number of spacer elements $N_P$=5. This results in an initial perforation line length of 55 mm, which is 5 mm more than the edge length L. Thus, the system must adjust the number and/or size of the perforation elements.

In one embodiment, the system may make this adjustment by decreasing the lengths of the perforation line elements to be less than the default lengths. For example, the perforation line for a crease cut with eleven elements described above may be represented by the sequence PCPCPCPCPCP, where P=paper (or other substrate) spacer element and C=cut segment element. In one embodiment, the system may do this by dividing the edge length by the number of perforation line elements, resulting in L=(length of edge)/N, in this case 4.54 mm. Optionally, the system may make the adjustment for all elements that do not reach the end of the line, while preserving the length of the perforation elements that are positioned at the ends of the perforation line, resulting in P1 and P11=5 mm, while all other perforation elements have a length l=(L−(2×5 mm))/(N−2)=4.44 mm.

Thus, before updating the package design file, the system may determine whether the length of the perforation line using the number of perforation elements ($N_P$*$l_P$+$N_C$*$l_C$) exceeds the length of the edge 325. If so, the system may reduce 334 the length of the cut segments, the length of the spacers, or both so that the total length of all elements does not exceed that of the edge. Optionally, when performing this function the system may determine whether the length of one or more end elements must be preserved 332, either at a default size or at least to a minimum size. If so, it will preserve the length of those end elements to at least the minimum size while reducing the length 334 of one or more interior elements of the cut line.

In some embodiments, when determining a size and number of cut segments to apply to an edge as a perforation line, the system may apply one or more rules that are based on the characteristics such as a function of the edge, length of the edge, or category of facet to which the edge is adjacent. For example, some edges may be so small that no perforation line should be applied if the default cut length and spacer lengths were applied to the edge. If so, the rule may be to apply no perforation unless the length of the edge is at least a minimum threshold value. In addition, small edges (such as those that attach a small tab to a much larger face) may require a lower aspect ratio (i.e., low ratio of cut segment length to spacer length) to maintain structural integrity. If so, edges having a length under a threshold value may receive a perforation cut line with a lower aspect ratio, while longer edges may receive a perforation line with a higher aspect ratio. As another example, if the two facets connected by an edge are intended to be a lid and a lip, then the rule may require that a perforation cut line suitable for a fold (with no cut segments reaching either end of the edge) be applied. On the other hand, if one of the two facets is intended to be a removable section, then the rule may require that a separation cut line be applied (with cut segments reaching each end of the edge).

The rule set may be in any form, such as a table of rules that apply based on various characteristics of the edge and/or adjacent facets. For example, consider the following table:

| Line Length | $l_c$ | $l_p$ | $N_c$ | $N_P$/unprotected | N | $P_1$, $P_N$ |
|---|---|---|---|---|---|---|
| 13 mm | 1 mm | 1 mm | 2 | 3/1 | 5 | 5 mm |
| 16 mm | 2 mm | 2 mm | 2 | 3/1 | 5 | 5 mm |
| 20 mm | 2 mm | 2 mm | 3 | 4/2 | 7 | 5 mm |

Figure 5:
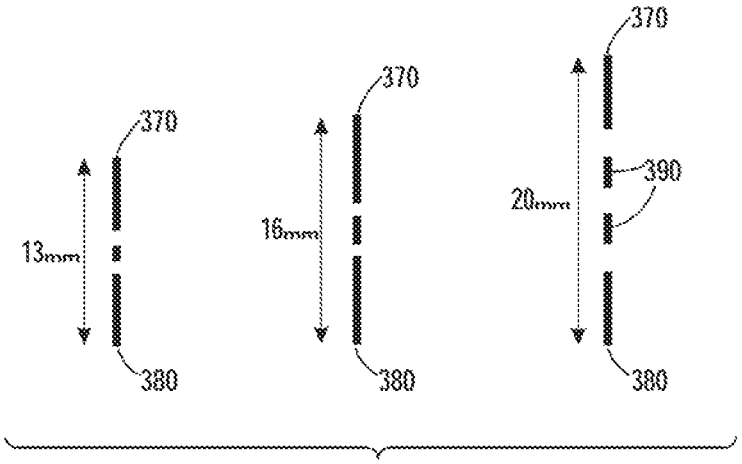
FIG. 5 illustrates an example of how perforation cut segments and sizes may be established in an embodiment.

In this example, using (i) a default perforation cut segment length of 5 mm and (ii) a rule that the sizes of the endmost spacers ($P_N$ P) must remain at 5 mm, the element combinations (size and number) listed in the table may result for the illustrated line (edge) length. In essence, this protects the outside of the perforation line and sets a minimum number (2) for the inside cuts. In addition, it reduces the length of each perforation cut element and unprotected (i.e., non-endmost) spacer from 5 mm to 2 mm or 1 mm, based on the length of the edge. An example of this is shown in FIG. 5 with elements P 370, $P_N$ 380 and lp 390 having example sizes for purpose of illustration only.

In some embodiments, two crease and/or cut lines may intersect in a package flat. This is shown by way of example in FIG. 6, where a non-perforation crease line 401 meets a perforation line 402. It may be desirable to avoid the result shown by this combination, as the centermost cut segment in the perforation line 402 is adjacent to the end of crease line 401. When the package is folded, this intersection could result in structural weakness and/or an undesired opening. To avoid this, the system may adjust the perforation line 402 by dividing it into two separate cut lines 412 and 422, each having a phasing that ensures that a spacer area (substrate) is present at the end. This ensures that the adjacent end points of each perforation line 412 and 422 are not adjacent to the end of crease 401. In this situation, the rule set may include a hierarchy, giving priority to preserving the crease over the perforation cut.

Figure 6:
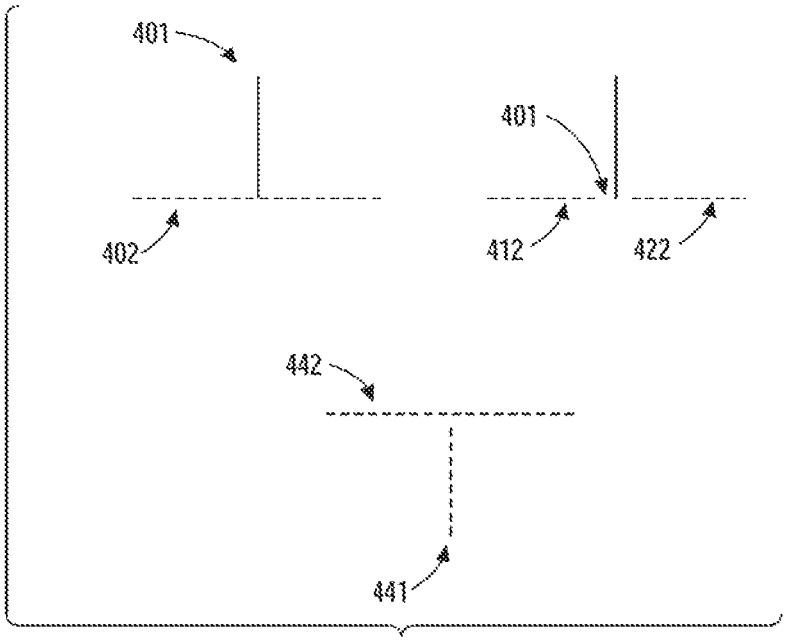
FIG. 6 is a diagram showing how various types of perforation cut lines and crease lines may intersect on a substrate.

As another example, FIG. 6 also illustrates the intersection of two perforation lines 441 and 442. Here, the longer of the two perforation lines 442 is given priority, where it may have any phase but the shorter line 441 is forced into a phasing that ensures that a spacer area (substrate) is present at the end.

Figure 7:
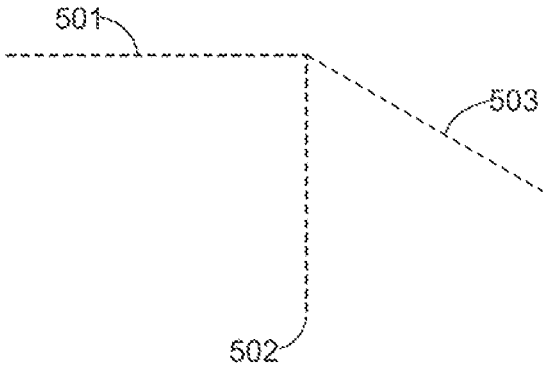
FIG. 7 is a diagram showing how additional types of perforation cut lines may intersect on a substrate.

Any suitable rule set may be applied, using a hierarchy, conditions based on edge type, or other criteria to determine which of the two intersecting lines is given priority, and what phasing or other adjustments are applied to the lower priority line. Another example is shown in FIG. 7, where three intersecting perforation cut lines 501, 502 and 503 each have a cut segment at the point of intersection. To avoid this result, each line may be adjusted to have a phasing that ensures that a spacer area (substrate) is present at the end point (i.e., the intersection).

To create a package, the system may apply the package design file and a rule set that may include, for example, a set of cutting and/or scoring instructions that a package generating device may use to apply cut lines and/or crease lines to a substrate. The instructions may be saved to a computer readable memory such as a package generation file. The instructions may include a series of instructions to either (a) apply a cut or crease line to the substrate, or (b) move the cutting or creasing tool to a new position on the substrate without altering the substrate. The system may then use a package generation device to apply the package generation rule set by imparting cut lines and crease lines to a substrate to yield a package flat.

Figure 8:
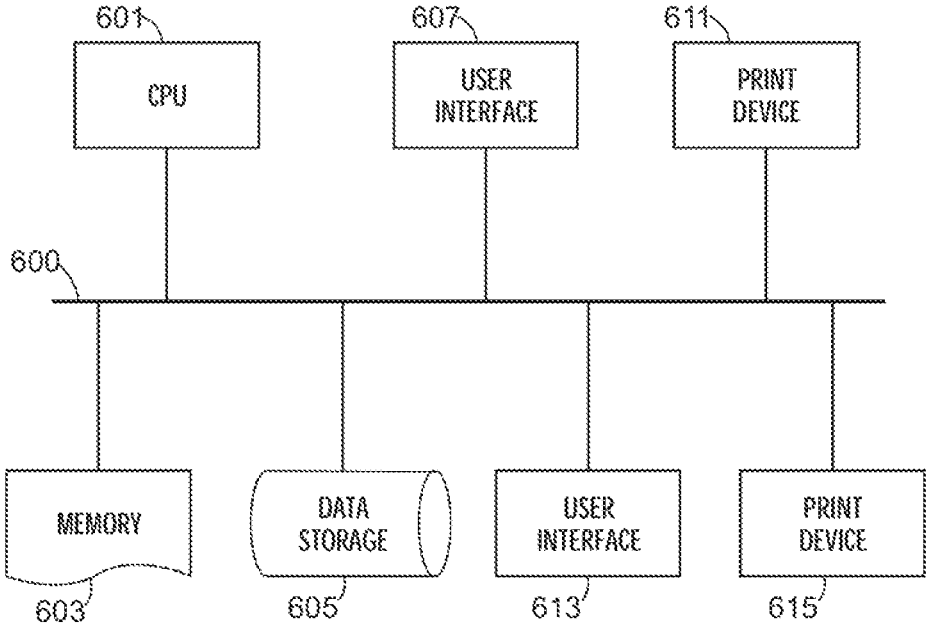
FIG. 8 is a block diagram showing various equipment that may be used to implement various embodiments of the processes described in this document.

FIG. 8 depicts a block diagram of hardware and/or electronics that may make up a package definition and/or production system. One or more communications lines 600 such as a bus or network interconnect the illustrated components and allow data and/or signals to flow between the components. Central processing unit (CPU) 605 is a processor that performs calculations and logic operations required to execute a program. Any number of processors may be available, and they may access a tangible, computer-readable memory device 603 containing programming instructions, along with a data storage facility 605 such as a database that stores the package generation templates and/or rule sets.

A user interface 607 provides output to, and receives input from, a user. The user interface may include a display, audio output, a printer, or another element that provides information to a user. The user interface 607 also may include a touch-sensitive component, microphone, audio port, keyboard, mouse, touch pad, or other input mechanism that is capable of receiving user input.

The system also may include a package generation device, which may include some or all of the following elements: a print device 611; a knife, laser or other cutting device 613; and a roller or other device 615 capable of imparting a crease in a substrate.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A method comprising, by a processor:

accessing a package design file comprising a two-dimensional representation of a three-dimensional structure having a plurality of facets;

identifying an edge between two facets to which a perforation line is to be applied, the perforation line comprising a plurality of cut segments and a plurality of spacers;

determining a length of the edge;

determining an aspect ratio of a default cut segment length to spacer length;

using the length of the edge and the aspect ration to determine a number of cut segments that will be included in the perforation line;

if the number of cut segments is not an integer, determining an integer number of cut segments by rounding the number of cut segments up or down, setting the number of cut segments to equal the integer number of cut segments, and determining a revised cut segment length based on the integer number of cut segments and the edge length;

and updating the package design file to include data indicating that the perforation line will include the integer number of cut segments and the revised cut segment length.

2. The method of claim 1, wherein determining the revised cut segment length comprises, by the processor:

determining that the integer number of cut segments at the default cut segment length will result in a perforation line length that exceeds the length of the edge; and in response, implementing a reduction process comprising reducing the cut segment length of at least one of the cut segments, a length of at least one of the spacers, or both.

3. The method of claim 2, wherein the reduction process further comprises, by the processor:

determining that a minimum length must be preserved for a spacer that is positioned at an end of the perforation line; and limiting reduction of the length of the spacer that is positioned at the end to the minimum length, while reducing the length of at least one other spacer in the line to a length that is below the minimum length.

4. The method of claim 2, wherein the reduction process further comprises, by the processor:

determining that a minimum length must be preserved for a cut segment that is positioned at an end of the perforation line; and limiting reduction of the length of the cut segment that is positioned at the end to the minimum length, while reducing the length of at least one other cut segment to a length that is below the minimum length.

5. The method of claim 1, wherein determining the number of cut segments to include the perforation line comprises:

determining whether the edge will be a crease; and setting the number of cut segments as an even number.

6. The method of claim 1, wherein determining the number of cut segments to include in the perforation line comprises:

determining whether the edge will be a separation line; and setting the number of cut segments as an odd number.

7. The method of claim 1, further comprising:

determining that a first end of the perforation line will be adjacent to another edge in the three-dimensional structure; and ensuring that a phasing of the perforation line is such that the first end will be a spacer and not a cut segment.

8. A package definition system, comprising:

a data storage facility containing a package design file;

a processor;

and a computer-readable medium containing programming instructions that, when executed, instruct the processor to: select, from the data storage facility, a package design file comprising a two-dimensional representation of a three-dimensional structure having a plurality of facets;

identify an edge between two facets to which a perforation line is to be applied, the perforation line comprising a plurality of cut segments and a plurality of spacers;

determine a length of the edge;

determine an aspect ratio of a default cut segment length to spacer length;

use the length of the edge and the aspect ration to determine a number of cut segments that will be included in the perforation line;

if the number of cut segments is not an integer, determine an integer number of cut segments by rounding the number of cut segments up or down, setting the number of cut segments to equal the integer number of cut segments, and determining a revised cut segment length based on the number of cut segments the edge length;

and update the package design file to include data indicating that the perforation line will include the integer number of cut segments and the revised cut segment length.

9. The system of claim 8, wherein the instructions that instruct the processor to determining the revised cut segment length comprise instructions to:

determine that the integer number of cut segments at the default cut segment length will result in a perforation line length that exceeds the length of the edge; and in response, implement a reduction process comprising reducing the cut segment length of at least one of the cut segments, a length of at least one of the spacers, or both.

10. The system of claim 9, wherein the instructions that instruct the processor to implement the reduction process further comprise instructions to:

determine that a minimum length must be preserved for a spacer that is positioned at an end of the perforation line; and limit reduction of the length of the spacer that is positioned at the end to the minimum length, while reducing the length of at least one other spacer in the line to a length that is below the minimum length.

11. The system of claim 9, wherein the instructions that instruct the processor to implement the reduction process further comprise instructions to:

determine that a minimum length must be preserved for a cut segment that is positioned at an end of the perforation line; and limit reduction of the length of the cut segment that is positioned at the end to the minimum length, while reducing the length of at least one other cut segment to a length that is below the minimum length.

12. The system of claim 9, wherein the instructions that instruct the processor to determine the number of cut segments to include the perforation line comprises:

determine whether the edge will be a crease; and set the number of cut segments as an even number.

13. The system of claim 9 wherein the instructions that instruct the processor to determine the number of cut segments to include the perforation line comprises:

determine whether the edge will be a separation line; and set the number of cut segments as an odd number.

14. The system of claim 8, further comprising additional programming instructions that, when executed, instruct the processor to:

determine that a first end of the perforation line will be adjacent to another edge in the three-dimensional structure; and ensure that a phasing of the perforation line is such that the first end will be a spacer and not a cut segment.

15. The system of claim 8, further comprising a package generation device, configured to apply a rule set to data in the package design file to impart a plurality of cut lines and crease lines to a substrate to yield a package flat that, when folded, forms the three-dimensional structure.

16. A method comprising, by a processor:

accessing a package design file comprising a two-dimensional representation of a three-dimensional structure having a plurality of facets;

identifying an edge between two facets to which a perforation line is to be applied, the perforation line comprising a plurality of cut segments and a plurality of spacers;

determining a length of the edge;

determining an aspect ratio of a default cut segment length to spacer length;

using the length of the edge and the aspect ratio to determine a number of cut segments that will be included in the perforation line;

if the number of cut segments is not an integer, determining an integer number of cut segments by rounding the number of cut segments up or down to equal an even or odd integer based on whether the edge will be a crease or a perforation line, selecting an even or odd integer based setting the number of cut segments to equal the integer number, and determining a revised cut segment length by:

determining that the integer number of cut segments at the default cut segment length will result in a perforation line length that exceeds the length of the edge, and in response, implementing a reduction process comprising reducing the cut segment length of at least one of the cut segments, a length of at least one of the spacers, or both;

and updating the package design file to include data indicating that the perforation line will include the integer number of cut segments and the revised cut segment length.

17. The method of claim 16, wherein the reduction process further comprises, by the processor:

determining that a minimum length must be preserved for a spacer that is positioned at an end of the perforation line; and limiting reduction of the length of the spacer that is positioned at the end to the minimum length, while reducing the length of at least one other spacer in the line to a length that is below the minimum length.

18. The method of claim 16, wherein the reduction process further comprises, by the processor:

determining that a minimum length must be preserved for a cut segment that is positioned at an end of the perforation line; and limiting reduction of the length of the cut segment that is positioned at the end to the minimum length, while reducing the length of at least one other cut segment to a length that is below the minimum length.

* * * * *